US005492165A

United States Patent [19]

Erana

[11] Patent Number: 5,492,165

[45] Date of Patent: Feb. 20, 1996

[54] MACHINE FOR FILLING SAND MOULDS WITH NON-FERROUS METALS USING A LOW PRESSURE TECHNIQUE

[76] Inventor: Agustin A. Erana, Zorrestea - 4. Poligano Industrial Ali-Gobeo, 01010 Vitorio (Alava), Spain

[21] Appl. No.: 156,251

[22] Filed: Nov. 22, 1993

[30] Foreign Application Priority Data

Nov. 20, 1992 [ES] Spain ..... 9202341
Sep. 6, 1993 [ES] Spain ..... 9301912

[51] Int. Cl.[6] ..... B22D 18/04; B22D 18/06; B22D 23/00

[52] U.S. Cl. ..... 164/255; 164/63; 164/119; 164/136; 164/306

[58] Field of Search ..... 164/255, 306, 164/309, 63, 119, 136

[56] References Cited

U.S. PATENT DOCUMENTS 4,733,714 3/1988 Smith ..... 164/136 X
4,982,777 1/1991 Chandley ..... 164/63
5,146,973 9/1992 Chandley ..... 164/63
5,163,500 11/1992 Seaton et al. ..... 164/136 X
5,297,611 3/1994 Legge et al. ..... 164/353
5,303,762 4/1994 Chandley ..... 164/255 X

FOREIGN PATENT DOCUMENTS 240954 5/1970 U.S.S.R. ..... 164/255
553040 6/1977 U.S.S.R. ..... 164/309

*Primary Examiner*—J. Reed Batten, Jr.
*Attorney, Agent, or Firm*—Helfgott & Karas

[57] ABSTRACT

The machine for filling moulds with metal to be cast, in which a casing is provided comprises a fixed body and a mobile body. The mobile body is driven by a cylinder. The casing can be provided with a vacuum chamber which when closed houses, with the ability to rotate, a sand mould clamped in a central turning body of a support which can be moved by another cylinder towards a lower injector which supplies the mould with the appropriate quantity of cast metal from a lower metering store. A pressure gas is inserted into the metering store through a connection. The metering store receives the cast metal from a larger tank with the assistance of a seal controlled by a level sensor. The machine also includes a metering ladle positioned between a filling plate and the mould itself. The metering ladle has heating elements.

4 Claims, 9 Drawing Sheets

MACHINE FOR FILLING SAND MOULDS WITH NON-FERROUS METALS USING A LOW PRESSURE TECHNIQUE

BACKGROUND OF THE INVENTION

The present invention relates to a machine that has been specifically designed to obtain metal casts based on non-ferrous metals, for instance aluminium casts, using sand moulds for such purpose and providing the mould with a vacuum to enhance its filling and avoid oxidations and microporosities.

The machine subject hereof is specifically aimed at filling the sand moulds and handling the same, from the moment they arrive at the machine to the moment they leave the same.

The sand moulds are filled using low pressure techniques, the mould being mounted on a rotating platform and a lower injector supplies the mould with the appropriate quantity of cast metal from a metering tank, communication between the injector and the mould taking place through a filling plate.

In a different embodiment the machine may be fitted between the filling plate and the very mould with a ladle acting as a metering device for the cast metal.

A machine manufactured by COSWORTH is known for aluminum casting, having a central rotating body receiving the sand mould. In this machine the mould is filled from a side position of the injector, after which the central body turns 180° . This machine does not use a vacuum and the sand mould enters and leaves through the same side of the machine.

European Patent 0 234 877 describes a method and a casting apparatus including a mould that is supplied from a vat where supply is made sideways, where the body supporting the mould turns, and hence in this case there is an antechamber storing the cast metal leading to the mould, although no means are provided to meter the quantity of cast metal that is to be supplied to the mould.

SUMMARY OF THE INVENTION

It is an object of the present invention to provide a said mould filling machine which is structured with a housing in which a vacuum chamber is established, the machine of the present invention comprising a lower body fixed to the housing and a mobile upper body, the latter driven by a hydraulic cylinder, so that the two parts making up the vacuum chamber can be tightly coupled for vacuum treatment.

The central body of the machine is found inside the aforesaid chamber, receiving the sand mould, and having means to clamp the mould. The central body can turn and is supported by a frame that can itself turn 180° for the filling plate, also working as a clamping means, to be coupled to the metal injector in the mould when the same is being filled.

When the mould is filled, the central body turns 180° in such a way that the mould, previously grouped, inverts its position for the filling plate to face the liquid state non-ferrous metal injector, with the assistance of a second coaxial cylinder, preferably the cylinder driving the upper part of the sealed chamber.

When a vacuum is established in the sealed chamber the liquid metal is injected.

Additionally to the above structure the machine is moreover fitted with a lower vat containing the metal, which goes through communicating vessels to a metering tank housed without the vat and with which it is communicated through a hole fitted with a seal, said metering tank having a level sensor that allows the quantity of cast metal that must be contained to be adjusted according to the part to be obtained in the mould, and a supply duct for the injector, which supply takes place applying within such metering deposit a low pressure inert gas, for instance nitrogen.

According to another characteristic of the invention, the sand mould lies and is held still within the central turning body with the assistance of side grips and the filling plate itself that works on the upper base of the mould. This filling plate has a nozzle for access of cast metal that is coupled to the injector when the central body turns 180°, the nozzle having an annular channel made of a metal having a high coefficient of heat conduction, such as copper, so that right after the mould filling operation, the said nozzle is strongly refrigerated by means of a water current circulating through the annular channel, causing the material within the mouth to quickly solidify, to stand as a closing stopper allowing the mould to be detached from the injector and turned 180° to return to the starting position, without the cast metal being spilt; once the mould is back at the starting position, the setting process of the ingates at the correct operative position continues, i.e. representing cast metal stores to supply the more massive parts during setting of the relevant part.

Clearly, with the structure described above, this machine contemplates all such factors as determine the obtention of a sound non-ferrous metal cast and at the same time improves the working rate and time lags are reduced.

Thus, working in a vacuum, viz. since the mould is filled in a sealed chamber provided with a vacuum, the vacuum itself fosters filling of the mould and moreover prevents the part from having porosities or oxidations, normally due to environmental humidity that obviously disappears when the vacuum is provided.

Furthermore, and as aforesaid, setting of the part takes place with the ingates in the right position, such setting being completed outside the machine and in particular at another station provided to such end outside the machine.

In an improved embodiment, the machine has a metering ladle with heating means, which ladle is arranged between the very mould and the filling plate. This metering ladle is provided to be filled with the required quantity of cast metal, from the injector that shall suitably face the same, in order that when the necessary quantity has been metered into the ladle, the filling nozzle shall be cooled or refrigerated in order for the latter, once set, to be separated from the oven, viz. from the actual injector, the mould turning at a speed that can be adjusted at will, the mould cavity being filled during such rotation and at the final correct positioning stage, the ladle being emptied, for the capacity of the latter shall accurately match the capacity of the mould chamber to be filled.

In this way no involvement will be required in supplying the mould with the cast metal and the hottest area shall remain on the upper part, because by virtue of the heating elements the cast metal shall be kept in the ladle at the desired casting temperature while the same is overturned for the metal to be poured.

BRIEF DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

DESCRIPTION OF THE PREFERRED EMBODIMENT OF THE INVENTION

Figure 1:
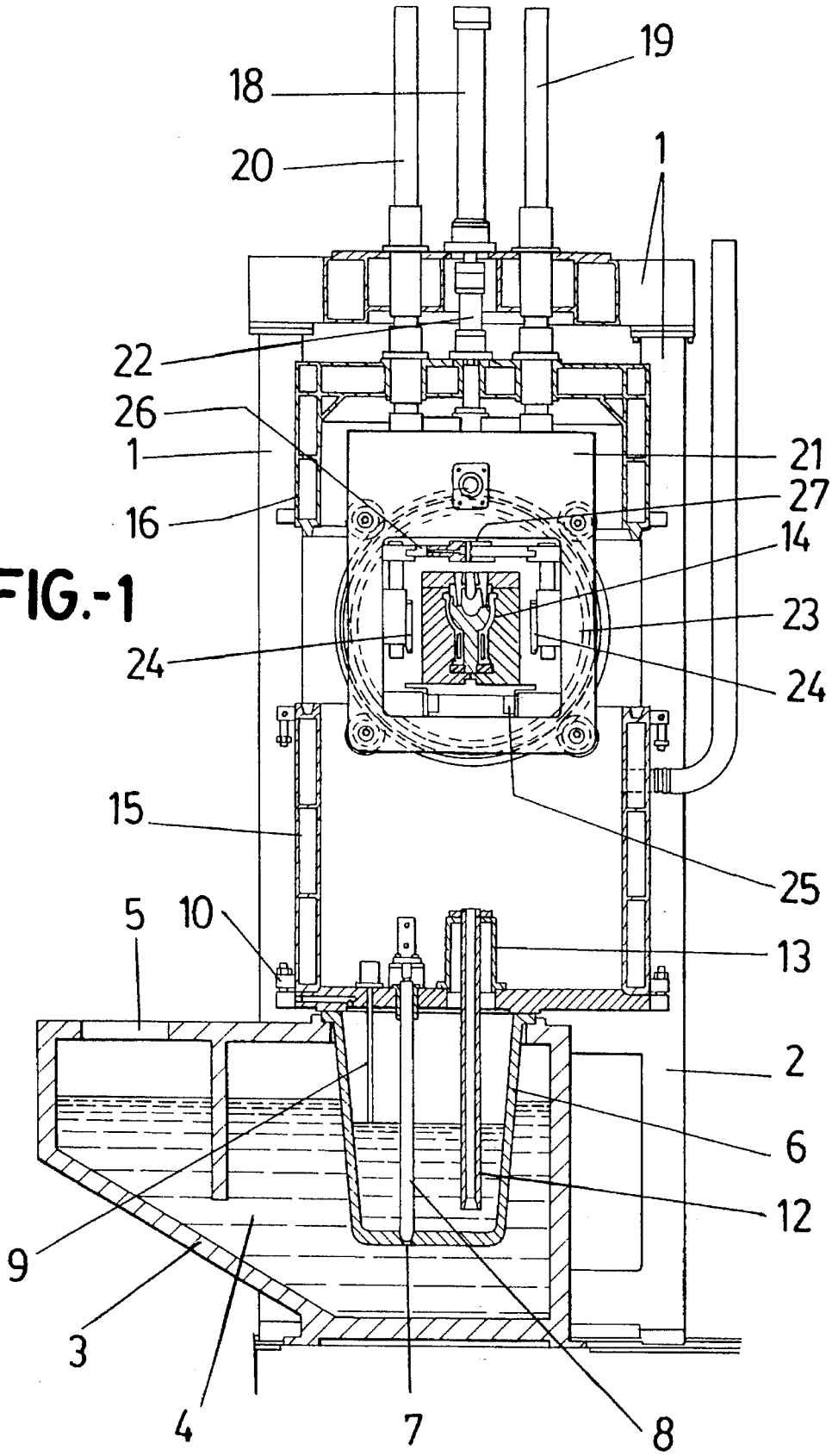
FIG. 1 is a front elevation section view of a machine for filling sand moulds with non-ferrous metals, made in accordance with the object of the present invention, at the first working stage, viz. receiving the mould carried by the appropriate tray.

The machine for filling sand moulds with non-ferrous metals of the invention includes a housing (1) of suitable dimensions, in which a lower sole (2) is defined housing a vat (3) for cast metal (4), the tank (3) having a mouth (5) to fill the same and means keeping the said (4) in a cast state, not shown in the figures.

Within such vat (3) there is a metering store or device (6) leading through its base to the former through a hole (7) acted upon by a seal (8), the metering device (6) moreover having a level sensor (9) governing the seal or stopper (8) in order to open or close the duct leading cast metal from the vat (3) to the metering store (6) through communicating vessels, in the necessary amount depending upon the part that is to be obtained.

The metering store (6) has a connection (10) to a low pressure source supplying an inert gas, for instance nitrogen, allowing the gas into the metering store when the mould is filled, the cast metal rising through the supply duct (12) to the injector (13) in charge of filling the mould (14).

On the metering store (6) there is provided a casing that can be tightly closed and is structured with a lower fixed body (15) and an upper mobile body (16) between which the seal (17) is established, the mobile body (16) being driven to be coupled to and uncoupled from the fixed body (15) by a cylinder (18) working with a pair of guides (19) and (20) mounted as the cylinder (18) on the upper part of the housing (1). The guides (19) and (20) also work to guide the frame (21) supporting the central turning body (23) and that arrives carried on a tray (25) moving on motorized supports.

Figure 7:
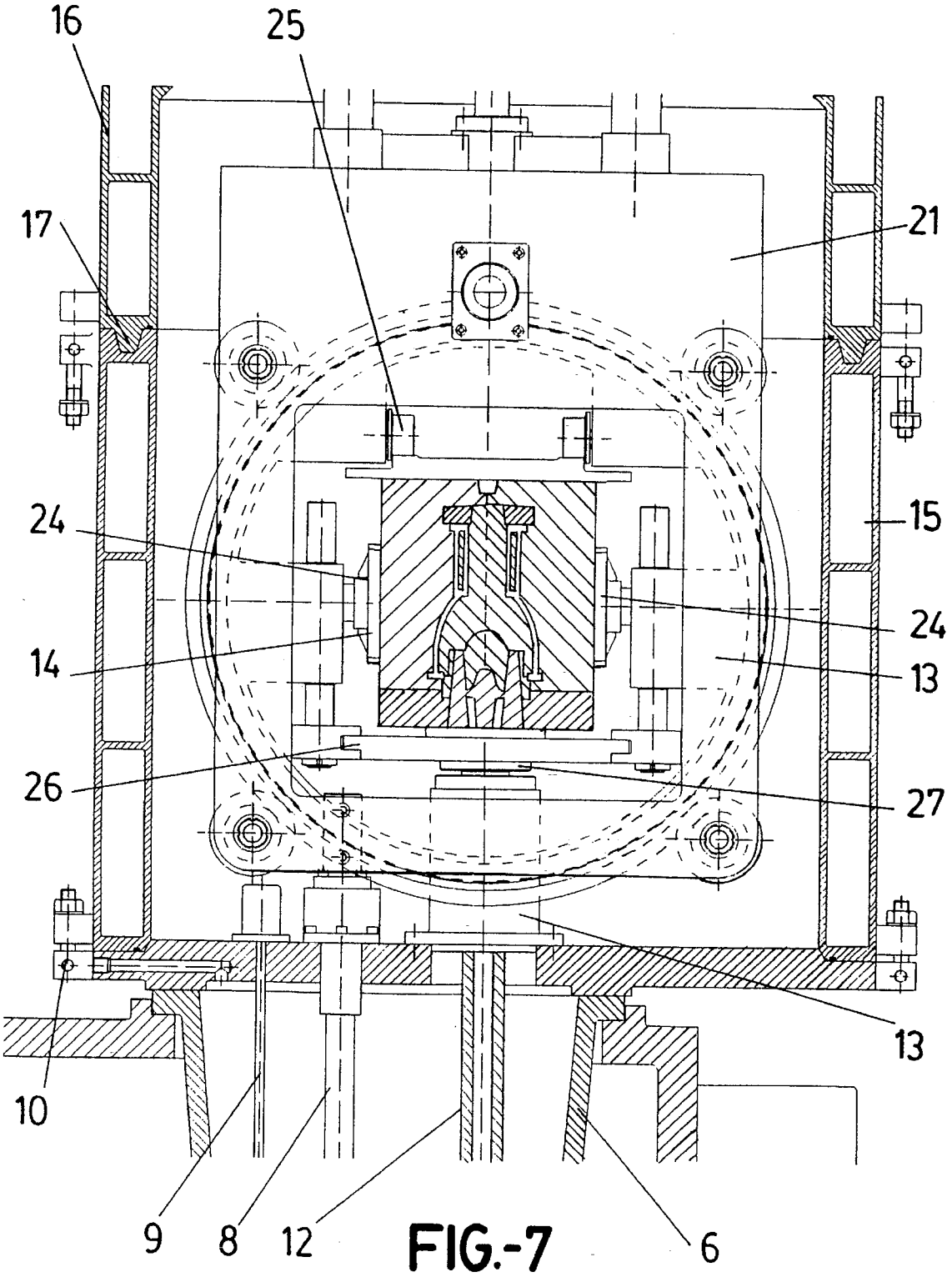
FIG. 7 is an enlarged close sectional view of the vacuum chamber, central turning body and frame thereof, showing the clamped mould and a 11 in the position of injection of the cast metal.
Figure 8:
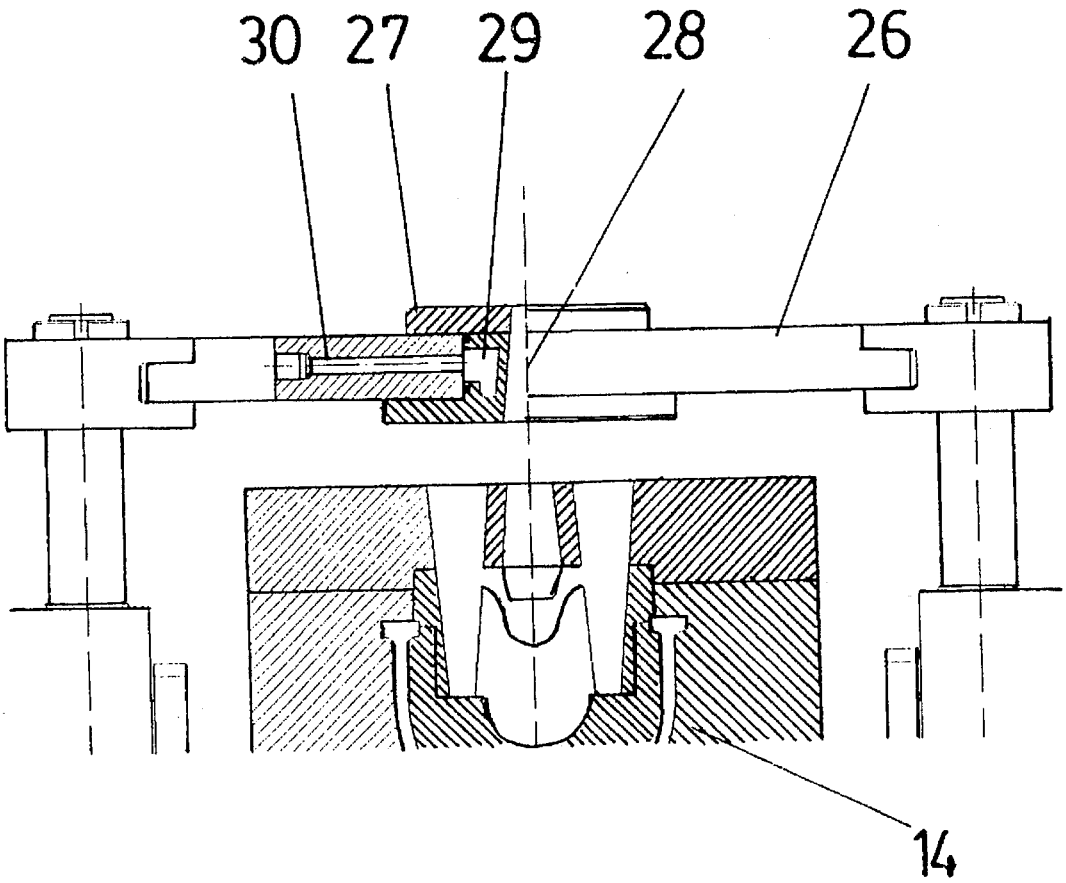
FIG. 8 is a close-view of the filling plate with the nozzle and the annular refrigeration channel.
Figure 9:
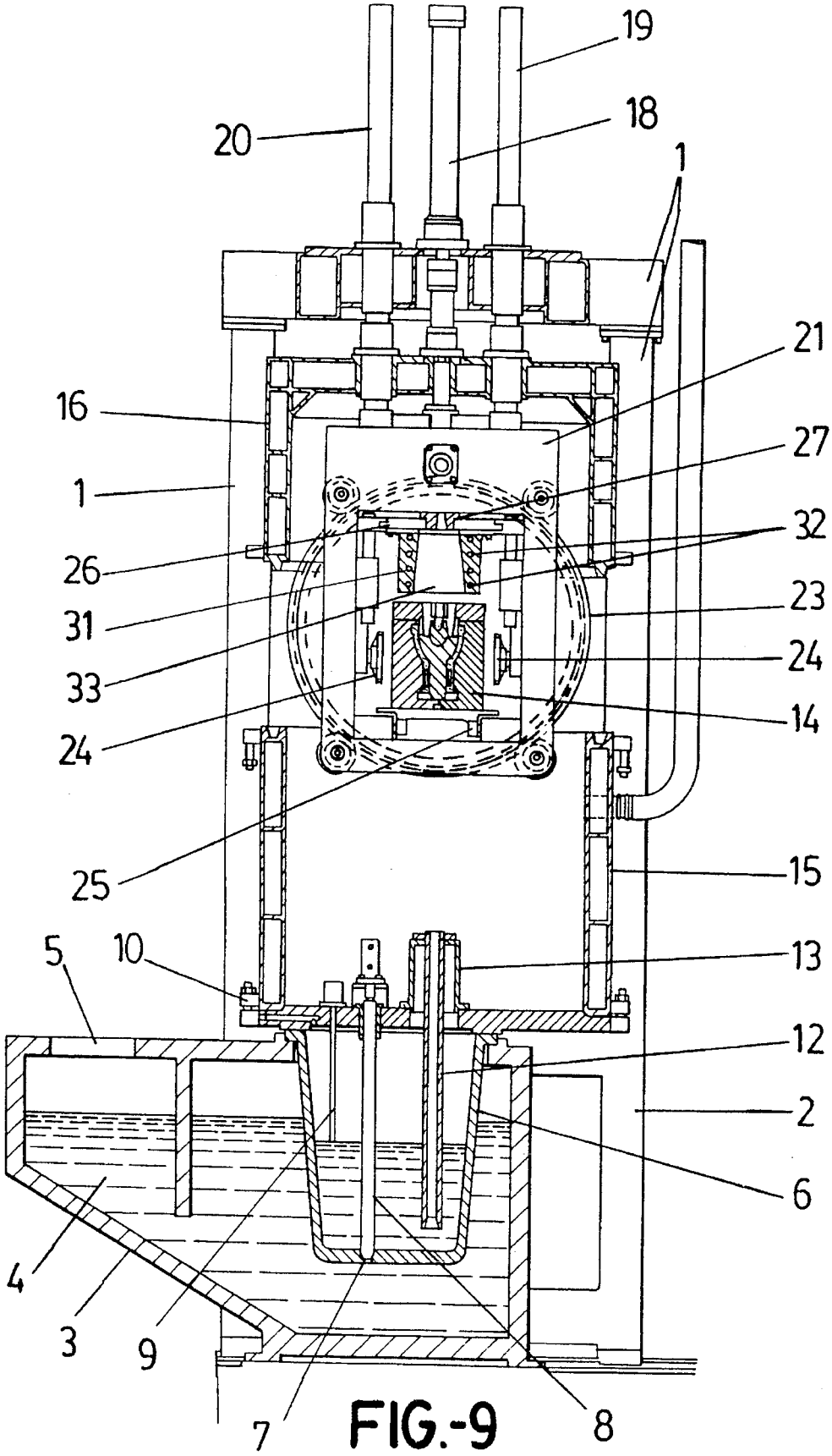
FIG. 9 is a frontal elevation and section view of the machine, similar to that of figure 1, but in the embodiment in which the machine has a metering ladle.

Once the mould (14) is within the central turning body (23) the latter has grips or clamps (24) pressing the same sideways to hold the same, the filling plate (26) being useful for this purpose, acting upon the lower base of the mould, as shown in FIG. 7.

Figure 3:
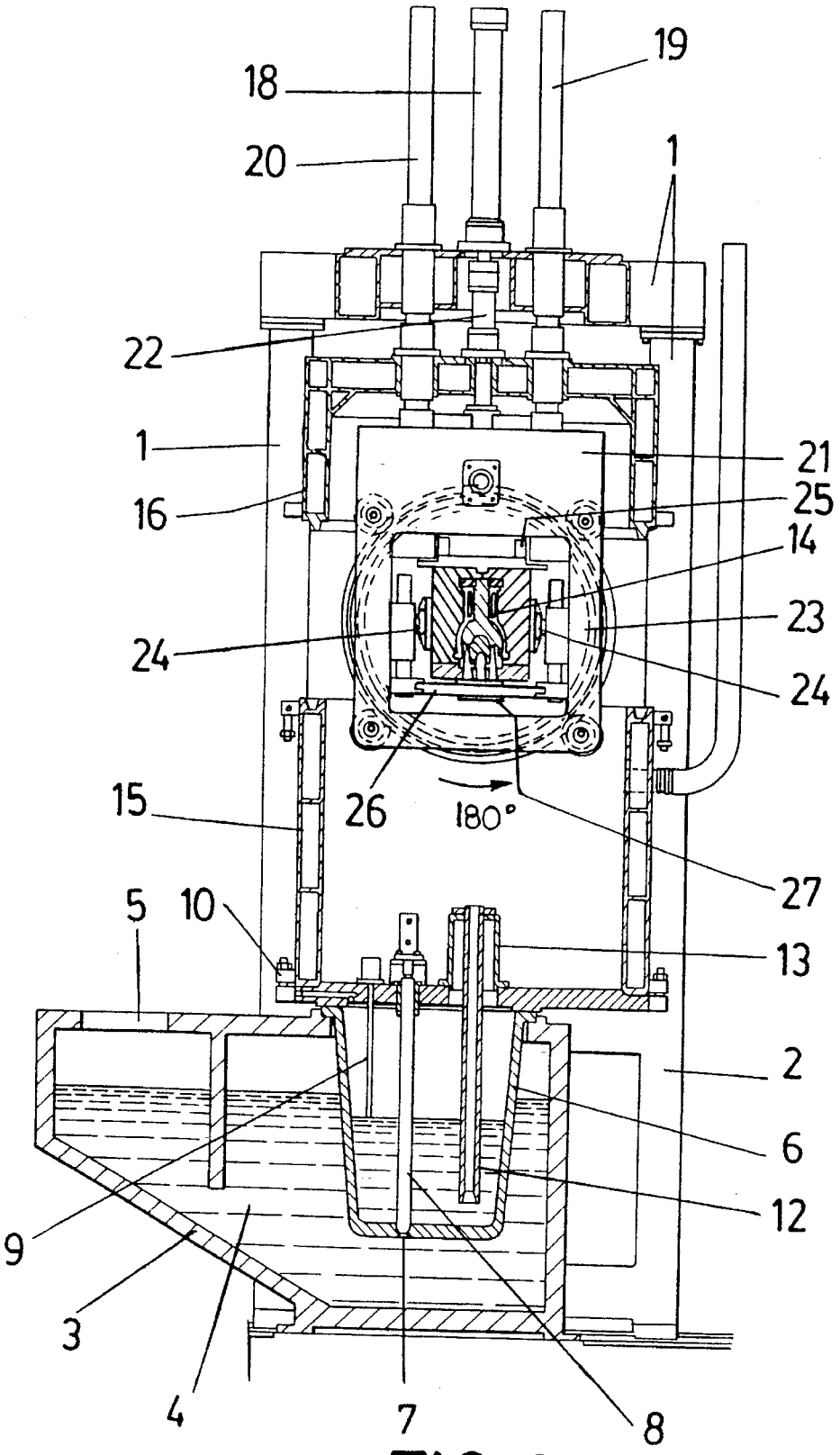
FIG. 3 is a front elevation section view of the same machine with the central body turning 180° on a vertical plane.
Figure 4:
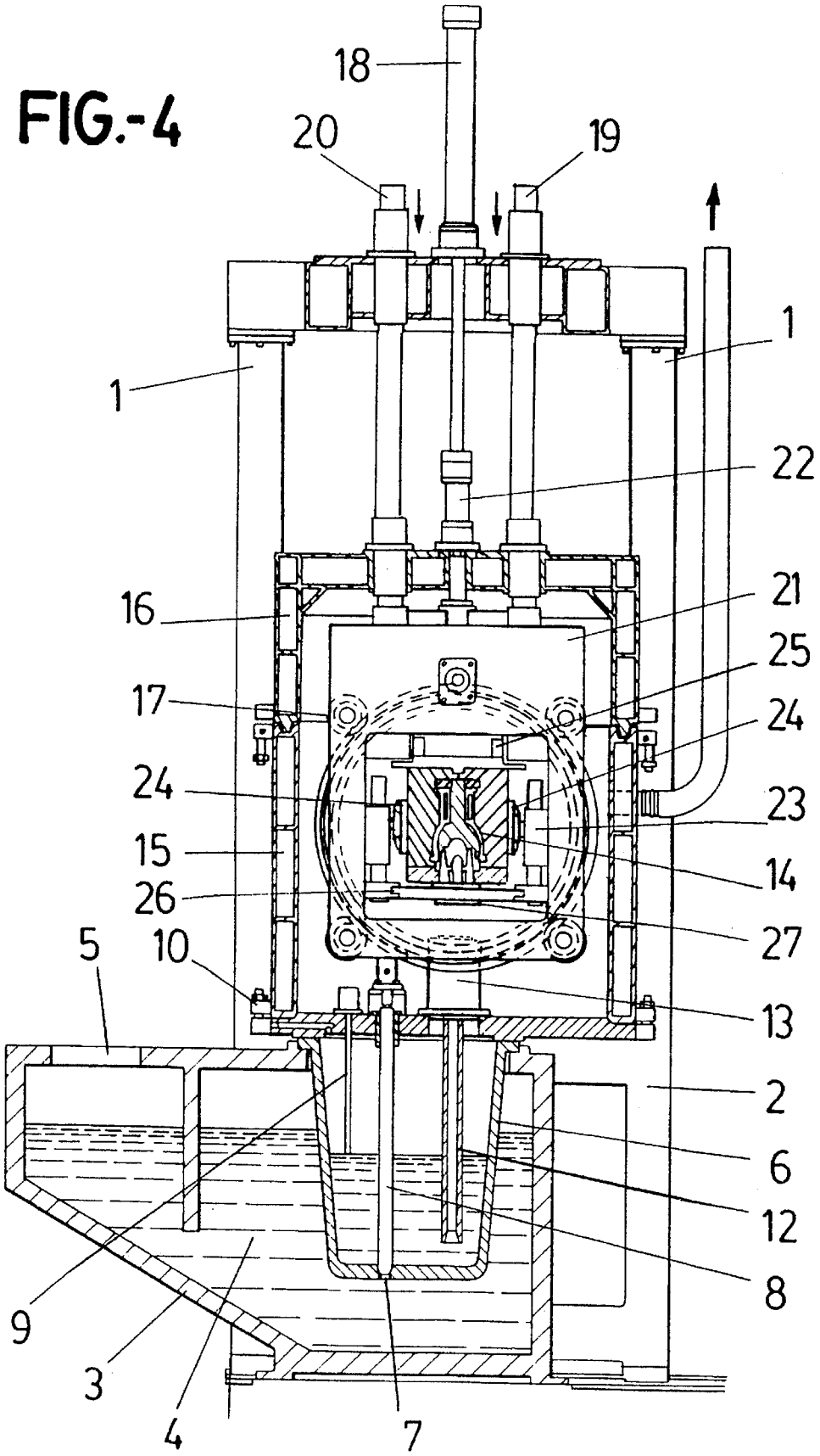
FIG. 4 is a front elevation section view of the same machine with the upper part of the chamber moving down to make up the sealed vacuum chamber and with it the frame locating the central turning body.

When the mould is pressed and held tightly within the central turning body (23) the assembly turns 180°, as shown in FIG. 3, and the chamber made up by bodies (15) and (16) is then tightly sealed, when the rod in the cylinder (18) moves its full stroke, as shown in figure 4.

Figure 5:
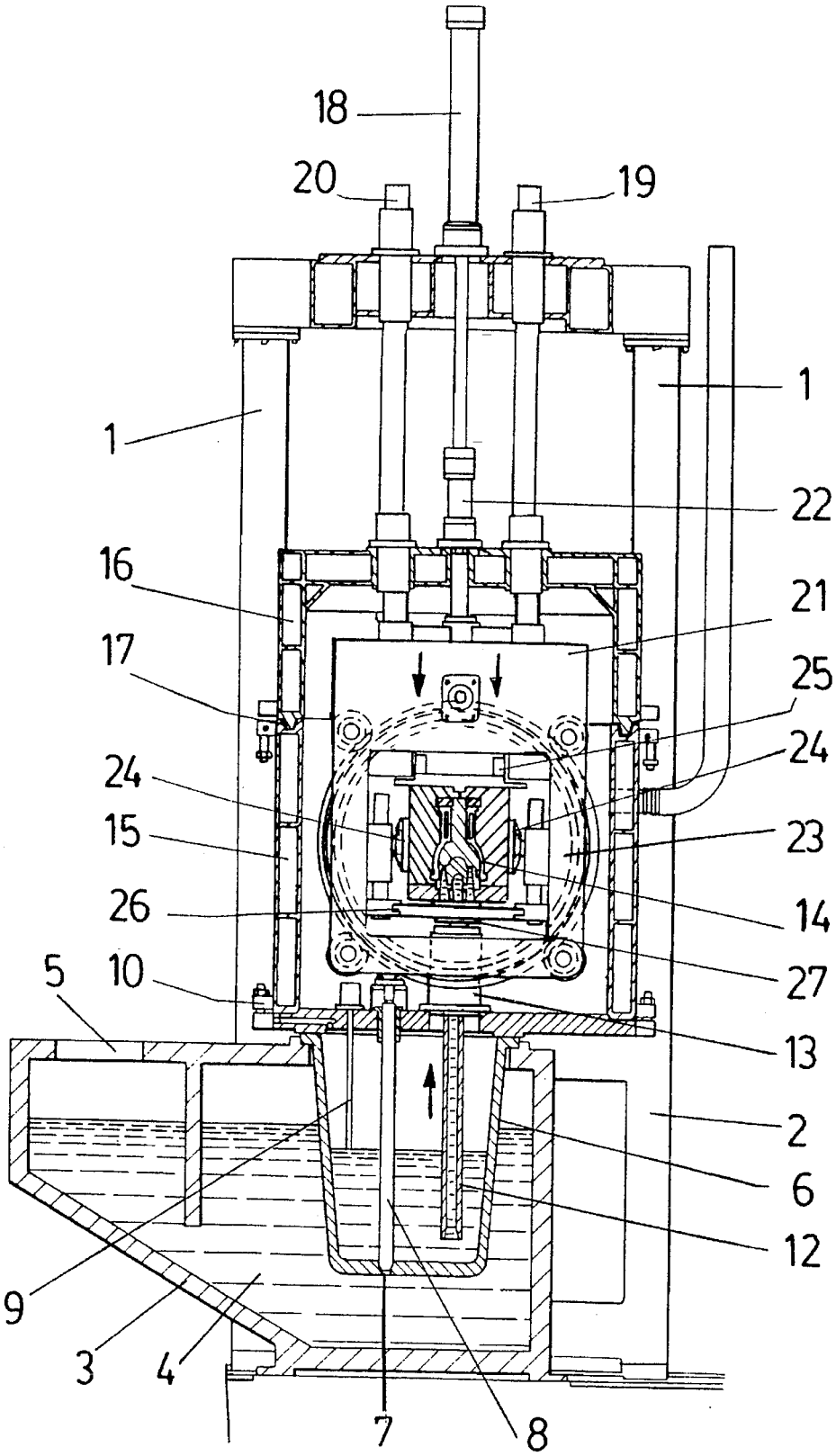
FIG. 5 is a front elevation section view of the same machine at the stage where the filling plate is coupled through the nozzle housed within it to the injector, when the second cylinder pushes against the frame containing the central turning body and in which after a vacuum is provided in the sealed chamber, the liquid metal is injected.

The next stage, shown in FIG. 5, is the coupling of the filling plate (26) to the injector (13) in which operation a second cylinder (22) is involved, mounted upon the upper base of the mobile body (16). Operation of the second cylinder causes the frame and with it the central turning body and the mould to be pushed, the latter mould being pressure coupled to the injector (13) through the filling plate (26).

The filling plate (26) has a central nozzle (27) having an axial bore (28), that is preferably frustum shaped, with its lower portion facing the injector (13) and the upper portion the sand mould (14).

Figure 6:
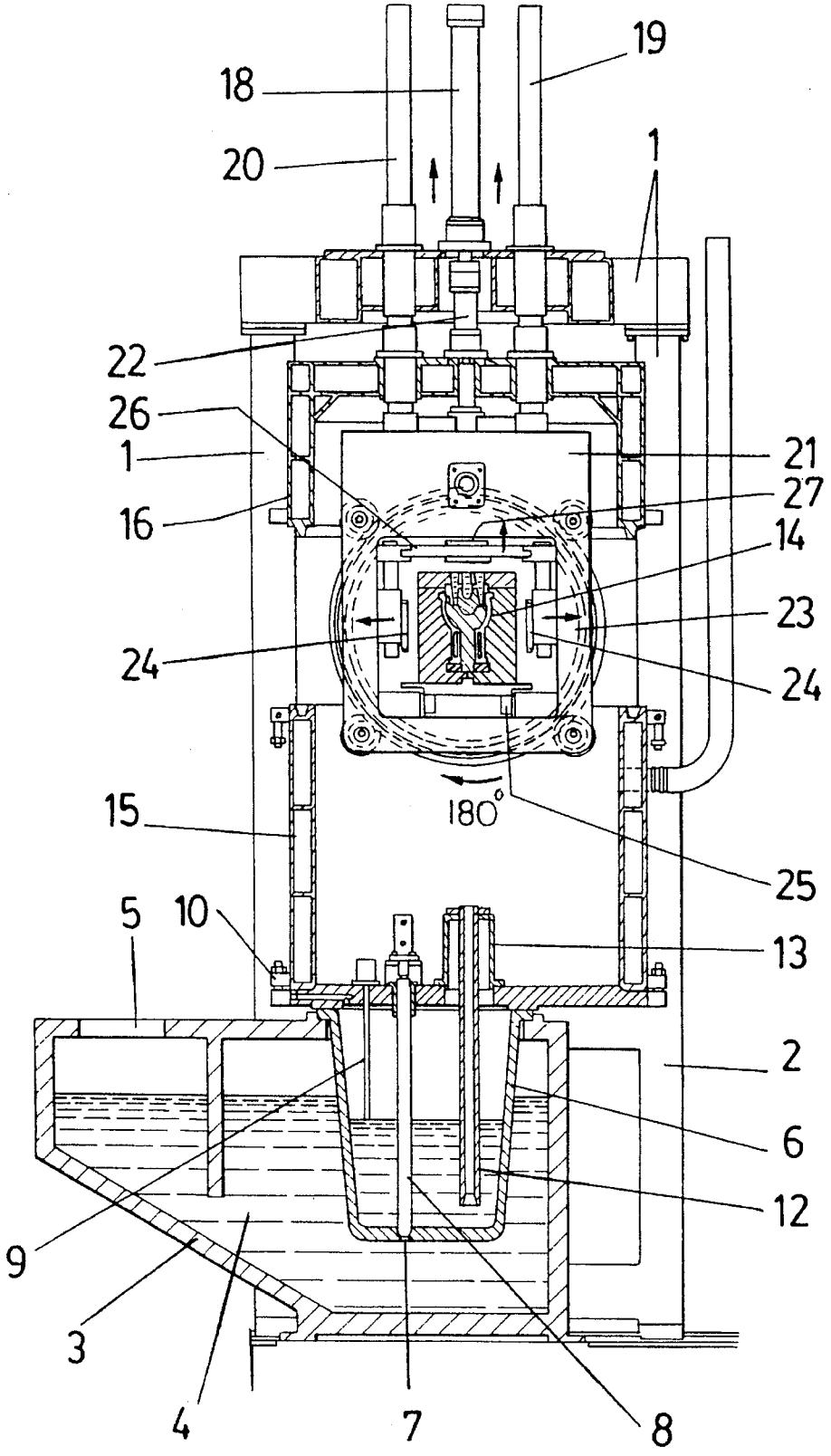
FIG. 6 is a front elevation section view of same machine with the vacuum chamber open, the frame lifted and the central body turned 180° wherein the mould can be seen unclamped and ready to leave the machine.

The nozzle (27) is made of metal having a good coefficient of heat conduction, such as copper, and is specifically particular in being fitted with a perimetric channel or duct (29) forming part with the assistance of radial ducts (30) of a refrigerating circuit and hence upon completion of the stage of injection of the cast material, cold water is circulated, which causes the metal located in the hole (28) to set quickly, forming a seal that can be readily eliminated later, provisionally sealing the outlet of the still cast metal inside the mould and ingates which hence allows the central body and the mould pressed within the same to turn 180° in order for the mould to return to the starting position, viz. with the ingates located at the upper part of the mould, as shown in FIG. 6. Thereafter, setting of the part shall continue outside the machine, with the mould in the appropriate position for the ingates to exercise their function in a more operative manner.

Figure 2:
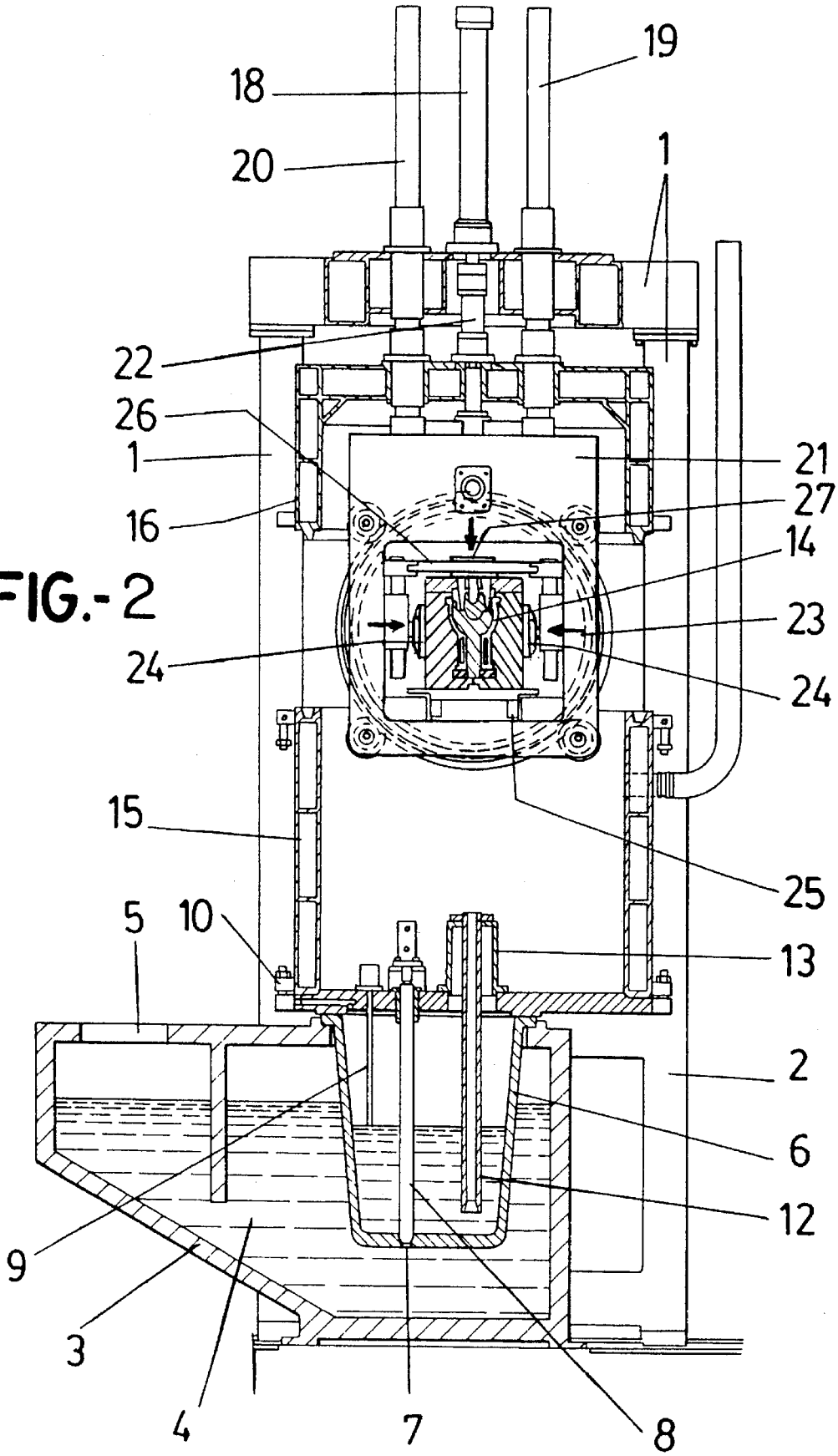
FIG. 2 is a front elevation section view of the same machine at the mould clamping or pressing stage.

Therefore, and in accordance with the structure described, operation of the machine and the stages of the operating sequence are as follows:

The mould carried on a tray mounted upon motorized supports enters the central turning body (23) where it is pressed and held still between the clamps and grips (24) and the filling plate (26). (FIGS. 1 and 2).

In the next sequence the central body turns 180° and the position of the sand mould is hence inverted (FIG. 3). The sealed chamber is then established upon the coupling of the bodies (15) and (16) by action of the cylinder (18), as shown in FIG. 4.

In the next sequence the frame upon which the central turning body is established is lowered by action of the second cylinder (22) until the filling plate (26) is coupled to the injector (13) whence the duct leading cast metal into the mould to be filled is communicated through the hole (28) in the nozzle (27).

When the mould and the injector have been coupled, the sealed chamber established upon the placing of bodies (15) and (16) on each other is provided with a vacuum and at the same time, through connection (10), nitrogen or another inert gas enters. It is clear that the vacuum itself will enhance the filling of the mould (14) and there will be no humidity in the resulting part nor will any defects appear due to porosities or oxidations (FIG. 5).

After totally filling the mould (14) the nozzle (27) mounted upon the center of the filling plate (26) is refrigerated, and in a matter of seconds the metal at the hole (28) shall set, representing a seal preventing the still liquid metal inside the mould from being spilt. This provisional sealing of the hole (28) allows the mould to be separated from the injector and turn 180° to take up the starting position, viz. with the ingates upon the part to be obtained. This stage, shown in FIG. 6, entails the withdrawal of the mobile body (16) and with it the frame (21) on which the turning body (23) is mounted.

The process ends with the unclamping of the mould (14) that leaves the machine through the side opposite the side through which it entered, the cycle beginning with the arrival within the central turning body of another sand mould.

As a different embodiment or optionally, the machine is fitted, between the filling plate (26) and the actual mould (14) with a metering ladle (31) having on its wall heating elements (32) such as electrical resistors or the like, in order for the inside (33) of the ladle (31) to define or establish a suitable capacity to fill the mould.

According to the working sequence or process of the machine described above, after supplying the ladle with the cast metal, the duct communicating both bodies is refrigerated, in particular the nozzle (27) and the space sets preventing metal from being spilt by such duct, separation of the injector taking place and the frame or support thereupon being overturned, i.e. turned 180° with the mould (14) and the cast metal contained in the metering ladle (31) poured into the mould, all so that by fitting the metering device it may be achieved that the hottest area, after pouring the metal into the mould, may remain on the upper part or hot top, thereby expediting a perfect filling of the mould (14) itself.

In short, it must be noted that once the necessary quantity has been metered into the ladle (31) and after cooling or refrigerating the filling nozzle (27), to set the cast metal at such area, separation from the relevant oven and turning of the mould shall take place at a speed that may be adjusted at will, thereby filling the mould cavity and emptying the ladle, all without any involvement whatsoever being required to supply the said mould.

I claim:

1. A machine for filling sand molds with non-ferrous metals using a low pressure technique, the machine comprising means for holding a mould; a housing including a lower vat containing metal to be supplied to and cast in said mould; an auxiliary metering store positioned in said vat and having a filling hole for communication with an interior of said vat, a stopper fitted in said filling hole, and a level sensor positioned in said metering store to control said stopper; means for supplying an inert gas into said metering store when said mould is filled with said metal; an injector having a duct in communication with an interior of said metering store; said means for holding the mould including a chamber having a fixed lower body fixed to said housing and a movable upper body; a first cylinder for vertically moving said upper body to said lower body to tightly close said upper body with said lower body so as to form a vacuum chamber having a tight seal at facing surfaces of said upper body with said lower body to tightly seal said chamber when closed; guide means for guiding said upper body in a movement thereof to and from said lower body; a frame vertically movable with said upper body by said first cylinder with aid of said guide means; a central turning body positioned in and supported by said frame, for receiving the mould therein, said central turning body turning 180° about a horizontal axis between a first position in which one side of the mould faces said injector and said metering store, and a second position in which an opposite side of the mould faces said injector and said metering store; clamps provided in said turning body for clamping the mould received therein; a filling plate positioned in said central turning body and having a nozzle for cooperating with said mould for filling the mould received and clamped in said central turning body; a second cylinder coaxial with said first cylinder and acting on said frame to push said frame with said central turning body holding said mould and said filling plate towards said injector when said central turning body is in said first position to couple said nozzle of said filling plate with said injector wherein, as said vacuum chamber is tightly sealed and inert gas is supplied by said supplying means to said metering store said metal is injected into said mould under pressure of said inert gas.

2. The machine according to claim 1, wherein said nozzle is made of a thermally conductive material and has an axial bore facing said injector to inject said metal to be cast therethrough into said mould in said first position of said turning body, and radially extending ducts and a channel surrounding said axial bore and communicating with said ducts, said channel and said ducts forming part of a refrigerating circuit using water to cool liquid metal contained in said mould upon injection of said metal into said mould so as to allow the mould held in said turning body and said frame to be separated from said injector and enable said turning body with said mould to be turned 180° to said second position without the liquid metal being spilled.

3. The machine according to claim 2, and further comprising a metering ladle positioned in said frame to face said mould when said mould is received in said turning body, said metering ladle having a wall including heating means, said wall forming a hollow inside said ladle for containing cast metal and being of a capacity sufficient to fill said mould, said heating means maintaining temperature of the metal contained in said ladle so that metal may be poured therefrom into said mould when said turning body is in said second position.

4. The machine according to claim 3, wherein said ladle is positioned such that an interior thereof is in communication with said nozzle so that metal may be injected into said mould through said ladle from said injector when said turning body is in said first position.

* * * * *